US006613387B2

(12) United States Patent
Agarwal et al.

(10) Patent No.: US 6,613,387 B2
(45) Date of Patent: Sep. 2, 2003

(54) PROTECTIVE REACTION RINSE FOR AUTODEPOSITION COATINGS

(75) Inventors: Rajat K. Agarwal, Brighton, MI (US); Douglas Brown, San Francisco, CA (US); William E. Fristad, Rochester Hills, MI (US); Graham Butcher, Buckingham (GB); Zafar Iqbal, Batley (GB)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 09/990,066

(22) Filed: Nov. 21, 2001

(65) Prior Publication Data

US 2002/0102356 A1 Aug. 1, 2002

Related U.S. Application Data

(60) Provisional application No. 60/252,799, filed on Nov. 22, 2000.

(51) Int. Cl.[7] ..... B05D 3/10; B05D 1/36; B05D 1/18

(52) U.S. Cl. ..... 427/340; 427/341; 427/386; 427/388.4; 427/410; 427/435; 148/243

(58) Field of Search ..... 427/340, 341, 427/386, 388.4, 410, 435; 148/240, 243

(56) References Cited

U.S. PATENT DOCUMENTS

| | | | | |
|---|---|---|---|---|
| 3,063,877 A | | 11/1962 | Schiffman | 148/6.16 |
| 3,585,084 A | | 6/1971 | Steinbrecher et al. | 148/6.2 |
| 3,592,699 A | | 7/1971 | Steinbrecher et al. | 148/6.2 |
| 3,647,567 A | | 3/1972 | Schweri | 148/6.15 |
| 3,709,743 A | | 1/1973 | Dalton et al. | 148/6.2 |
| 3,791,431 A | | 2/1974 | Steinbrecher et al. | 148/6.2 |
| 3,795,546 A | | 3/1974 | Hall et al. | 148/6.2 |
| 4,030,945 A | | 6/1977 | Hall et al. | 148/6.2 |
| 4,180,603 A | | 12/1979 | Howell, Jr. | 427/353 |
| 4,186,219 A | | 1/1980 | Hall | 427/8 |
| 4,186,226 A | | 1/1980 | Smith | 427/340 |
| 4,233,197 A | | 11/1980 | Howell, Jr. | 260/29.4 R |
| 4,289,826 A | | 9/1981 | Howell, Jr. | 428/418 |
| 4,313,861 A | | 2/1982 | Bassett et al. | 260/29.6 H |
| 4,414,350 A | | 11/1983 | Hall | 524/320 |
| 4,636,264 A | | 1/1987 | Schellenberg et al. | 148/6.2 |
| 4,636,265 A | * | 1/1987 | Fischer et al. | 148/258 |
| 4,800,106 A | | 1/1989 | Broadbent | 427/388.1 |
| 4,859,721 A | | 8/1989 | Oberkobusch et al. | 523/402 |
| 4,874,673 A | | 10/1989 | Donovan et al. | 428/463 |
| 5,294,265 A | | 3/1994 | Gray et al. | 148/250 |
| 5,500,460 A | | 3/1996 | Ahmed et al. | 523/402 |
| 6,033,492 A | * | 3/2000 | Honda et al. | 148/240 |
| 6,096,806 A | | 8/2000 | Mueller et al. | 523/402 |

* cited by examiner

*Primary Examiner*—Michael Barr
(74) *Attorney, Agent, or Firm*—Stephen D. Harper; Mary K. Cameron

(57) ABSTRACT

The anticorrosive properties of a coating autodeposited on a metal substrate are improved by contacting the autodeposited coating with an aqueous solution containing Group IIA or Group IIB metal cations (e.g., calcium or zinc cations) and phosphate anions prior to curing. The rinse solution is preferably acidic and can be prepared, for example, from calcium nitrate and an oxy acid of phosphorus or zinc dihydrogen phosphate. Optionally, the rinse solution also includes an accelerator such as hydroxylamine.

42 Claims, No Drawings

PROTECTIVE REACTION RINSE FOR AUTODEPOSITION COATINGS

REFERENCE TO RELATED APPLICATION

This application claims priority from provisional U.S. Application Ser. No. 60/252,799, filed Nov. 22, 2000, the disclosure of which is hereby incorporated by reference in its entirety.

FIELD OF THE INVENTION

This invention relates to a method of improving the anticorrosive properties of an autodeposition coating on a metal substrate by a post-bath rinse using an aqueous rinse solution in order to form what is believed to be a modified phosphate at the surface of the substrate. More particularly, the invention relates to a method of enhancing the anticorrosive properties of an autodeposition coating on a metal substrate using an aqueous rinse solution containing Group IIA and/or IIB metal cations and phosphate anions.

BACKGROUND OF THE INVENTION

Over the last few decades, various water-based coatings for metallic surfaces have been developed that are commonly referred to in the field as autodeposition coatings. These coatings utilize an emulsion (latex) or dispersion of a resin that is able to form a protective coating when cured. The coating typically is applied by immersing the metallic surface in a bath containing the resin emulsion or dispersion, acid, and an oxidizing agent to form an adherent coating that is initially wet. The thickness of the coating can be affected, for example, by such factors as total solids, pH and oxidant concentration. The coating thickness also is a function of the immersion time. The initial wet coating is sufficiently adherent to remain attached to the metal surface on which it is formed against the influence of normal gravity and, if desired, can be rinsed before being cured by heating to convert the wet coating to a dry, solid and even more adherent coating. However, a coating produced in this manner does not always provide adequate resistance against corrosion for the metal substrate, as determined, for example, by standard cyclic corrosion testing. These coatings are not always stable and can delaminate when exposed to superheated steam, boiling water, or salt spray.

The corrosion resistance of certain autodeposited coatings is significantly improved by rinsing the adhered coating, prior to curing, in an aqueous solution containing chromium ions. However, appreciable chromium ion concentrations are required to give acceptable coatings. The chromium rinse step is undesirable from an economic and environmental perspective, since chromium compounds are generally both expensive and highly toxic.

Examples of the above-described autodeposition coating compositions and coating and rinsing procedures are more fully described in U.S. Pat. Nos. 3,063,877; 3,585,084; 3,592,699; 3,647,567; 3,791,431; 4,030,945; 4,186,226; 3,795,546; 4,636,265; 4,636,264; and 4,800,006, each of which is incorporated herein by reference in its entirety.

Although these prior processes and compositions have been reasonably effective for the intended purpose, there is a continuing need in the industry for improved coating processes.

SUMMARY OF THE INVENTION

The present invention is directed to a method for enhancing the corrosion resistance of autodeposition coatings.

More particularly, the invention is directed to a method of improving the corrosion resistance of an autodeposition coating by using a rinse solution to form what is believed to be a modified metal phosphate at the surface of the metal.

In one embodiment, the present invention is a directed to a method of improving the corrosion resistance of a metallic surface having a cured autodeposited coating adhered thereto. The process comprises contacting an uncured autodeposited coating present on a metallic surface with an aqueous rinse containing effective amounts of at least one Group IIA or Group IIB metal cation source and at least one phosphate source.

Accordingly, one aspect of the invention is to provide a method of improving the corrosion resistance of an autodeposition coating using a rinse containing calcium nitrate and a phosphate source.

Another aspect of the invention is to provide a method of improving the corrosion resistance of an autodeposition coating using a rinse solution containing alkaline earth metal cations and phosphoric acid.

Another aspect of the invention is to provide a method of improving the corrosion resistance of an autodeposition coating using a rinse solution containing zinc cations and a phosphate source.

A further aspect of the invention is to provide a method of improving the corrosion resistance of an autodeposition coating using a rinse solution containing an alkaline earth metal compound, phosphoric acid and an accelerator such as hydroxylamine.

Still another aspect of the invention is to provide the foregoing method where the resin comprises an epoxy resin, an acrylic resin, or a combination of epoxy and acrylic resins.

Another aspect of the invention is to provide the foregoing method wherein the rinse solution step is maintained at a temperature of from about 20° C. to about 100° C. during contact with the uncured autodeposition coating.

A further aspect of the invention is to provide the foregoing method wherein the aqueous solution has a Group IIA and Group IIB metal cation concentration of from about 2 to about 300 mM/L, a phosphate source, and a pH of about 3.5 to about 4.0.

Another aspect of the invention is to provide the foregoing method wherein the rinse solution has a phosphate concentration of from about 10 mM/L to about 1000 mM/L.

In another embodiment, this invention provides a method for improving the anticorrosive properties of a resin (preferably, an epoxy resin, acrylic resin or epoxy-acrylic blended resin) autodeposited on a metal substrate, where the method comprises:

(a) contacting the metal substrate with an autodeposition bath containing the resin in emulsion form and an autodeposition activator until a layer of the resin of desired thickness (typically, about 5 to about 40 micrometers) is autodeposited on the metal substrate;

(b) rinsing the metal substrate having the layer of resin autodeposited thereon with a chromium-free aqueous solution prepared using from about 0.05 to about 5 weight percent (more preferably, about 0.1 to about 1 weight percent) of calcium nitrate; from about 0.1 to about 5 weight percent (more preferably, about 0.3 to about 1 weight percent) phosphoric acid; and from about 0.05 to about 5 weight percent (more preferably, about 0.1 to about 1.0 weight percent) hydroxylamine at a temperature of about 20° C. to about 100° C. at a pH of from about 3.5 to about 4.0 for an effective time to improve the anticorrosive properties of the resin; and (c) curing the layer of resin autodeposited on said metal substrate following the rinsing step (b).

The process described herein does not require the use of chromium compounds of any type, yet surprisingly furnishes coatings which are very effective in protecting metallic substrates against corrosion, even under very severe environmental conditions. Moreover, high quality coatings may be easily achieved using the present process (i.e., the appearance of the cured autodeposited coating is not adversely affected by the rinse). Another advantage of the present process is that since contacting the substrate with the rinse solution takes place after the coating is deposited on the substrate surface, no aspect of the autodeposition step need be changed from what is conventionally practiced. That is, while it may in theory be possible to treat the surface of the metal substrate with a phosphating solution in order to form a phosphate conversion coating on the substrate surface prior to autodeposition, such a phosphate conversion coating would likely interfere with the desired deposition of the resin on the substrate surface so as to require significant readjustment of the autodeposition conditions. It was unexpected that such a phosphating step could effectively be practiced after the autodeposition coating had been formed on the substrate surface, since it was quite uncertain whether reaction of the metal surface could be effected with the autodeposited coating covering the metal surface and whether such reaction, if achieved, would adversely alter the curing of the autodeposited resin and the appearance and other properties of the cured coating.

The above-noted aspects of the invention and other salient features will become apparent to one skilled in the art in view of the following detailed description of the invention.

DETAILED DESCRIPTION OF THE INVENTION

The present invention is directed to a method of improving the corrosion inhibiting properties of an autodeposition coating using a novel rinse solution. The rinse solution is contacted with the coated metal substrate to form what is believed to be a Group IIA or Group IIB metal-modified metal phosphate compound on the metal substrate surface prior to curing the coating.

The rinse solution according to the invention is an acidic aqueous solution containing a corrosion inhibiting amount of a Group IIA and/or Group IIB metal cation source and a phosphate source capable of forming a complex with the substrate metal being treated. Typically, the Group IIA or Group IIB metal cation source is a water soluble compound. The phosphate source is a compound that is able to provide phosphate anions in the aqueous rinse solution in an amount sufficient to form the desired metal phosphate layer on the substrate metal in an acidic medium. Although not completely understood, it is believed that the novel rinse solution forms a Group IIA or Group IIB metal-modified phosphate on the surface of the metal substrate. The resulting phosphate compound has been found to significantly enhance the corrosion inhibiting properties of the autodeposition coating.

Metal substrates that can be better protected against corrosion by application of the process of this invention may comprise iron, tin, nickel, lead, chromium, zinc, aluminum, or alloys thereof especially steel (e.g., cold rolled steel, galvanized steel), as well as surfaces that have been coated with one of these metals or alloys thereof.

The organic resins that are suitable for autodeposition on the surfaces of the metal substrates include a variety of resin materials in emulsion (latex) or dispersion form as known from numerous publications. Resins based on epoxy resins such as glycidyl ethers of polyhydric phenols (e.g. bisphenol A) are particularly suitable for use in the present invention. The epoxy resin emulsions, in addition to one or more epoxy resins, can contain cross-linkers, curatives, emulsifiers, coalescing solvents, accelerator components, activators and the like. Suitable epoxy resin-based autodeposition coating systems are described, for example, in U.S. Pat. Nos. 4,233,197; 4,180,603; 4,289,826; 4,859,721; 5,500,460; and 6,096,806, and U.S. Ser. No. 09/578,935 (filed May 25, 2000) and Ser. No. 09/964,181 (filed Sep. 25, 2001) each of which is incorporated herein by reference in its entirety. Other suitable resins may include polyethylene, polyacrylates (acrylic polymers), styrene-butadiene copolymers, phenolic and novolac resins, urethanes, polyesters, vinyl chloride homo- and copolymers, vinylidene chloride homo- and copolymers and the like.

Acrylic resins (polymers) may also be used as a component in the coatings of the present invention. The acrylic resins employed as a component may be generally described as polymeric substances obtained by polymerization of one or more acrylic monomers, possibly in combination with one or more non-acrylic monomers, which provide a stable (e.g. non-coagulating) autodeposition bath and yet are capable of forming an autodeposition adherent film comprised of the acrylic resin on the surface of an active metal when placed in contact with surface in the presence of an autodeposition accelerator. Non-exclusive examples of suitable acrylic monomers include acrylic acid, methacrylic acid, esters of acrylic acid and methacrylic acid (especially $C_1$–$C_8$ alkyl esters), acrylonitrile, methacrylonitrile, acrylamide, methacrylamide, and the like. Non-exclusive examples of non-acrylic monomers which may be copolymerized with the acrylic monomer(s) include vinyl aromatic monomers such as styrene, polymerizable ethylenically monounsaturated monomers, polymerizable vinylenically polyunsaturated monomers, vinyl esters of carboxylic acids such as vinyl acetate, and the like. Preferable, the acrylic resin selected for use is in dispersed or latex form ( i.e., fine particles stably dispersed in an aqueous medium). Suitable acrylic resin-based autodeposition coating systems are described, for example, in U.S. Pat. Nos. 3,585,084, 4,313,861, 3,709,743, and 4,874,673 and pending application Ser. No. 09/787,987 (filed Mar. 23, 2001). Combinations of different resins are also suitable, such as physical blends (mixtures) of epoxy resins and acrylic polymers as well as chemically bonded substances such as acrylic-urethane combinations.

As discussed hereinafter in greater detail, the Group IIA or Group IIB metal cation, the concentration of the Group IIA or Group IIB metal cation source, the concentration of the phosphate source, and rinse temperature can be varied from what is described in the Examples hereof in order for the corrosion resistance of the resulting coatings to be effectively improved.

The actual coating procedure for the autodeposition of the resin is according to known methods. Preferably the metal surfaces have been chemically and/or mechanically cleaned in the conventional manner prior to the coating step. This type of process is described in U.S. Pat. Nos. 3,791,431; 4,186,219 and 4,414,350, all of which are incorporated herein by reference in their entirety. Many other patents disclosing suitable coating processes are known by those skilled in the art. If desired, the uncured coatings may be rinsed with water alone immediately after the actual coating step and prior to rinsing with the rinse solution of the invention.

The Group IIA and Group IIB metal cation source present in the rinse solution may be supplied by means of a water-soluble Group IIA or Group IIB metal compound. Mixtures of different Group IIA and/or Group IIB compounds may be employed. In preferred embodiments, the Group IIA or Group IIB metal compound is a calcium or zinc compound. When a Group IIA compound is used, the anion portion is preferably a nitrate. Calcium nitrate, for reasons which are not well understood, has been found to be especially effective in improving the corrosion resistance of autodeposited coatings, particularly in the presence of a phosphate source in an acidic environment. Illustrative examples of other suitable alkaline earth metal compounds include calcium chloride, calcium acetate, calcium formate, barium nitrate, barium acetate, and magnesium benzoate. In further embodiments, mixtures of alkaline earth metal compounds can be used. The alkaline earth compound need not be of high purity; technical or industrial grade materials can often be employed, provided the impurities present do not interfere with the development of the desired anticorrosion properties of the cured coating. For example, the calcium nitrate granules sold under the designation Norsk Hydro CN by Norsk Hydro, which contain about 80% calcium nitrate, 10% ammonium nitrate, 1% strontium nitrate and 15% water, have been found to be quite effective in the rinse process described herein when dissolved in water.

Alternatively, the Group IIA and Group IIB metal cations in the rinse solution may be supplied by the use of water insoluble Group IIA and Group IIB metal compounds which are rendered soluble by treatment with acid or the like. Illustrative examples of such compounds include calcium phosphate, calcium oxide (lime), calcium hydroxide (slaked lime), calcium carbonate, zinc phosphate, zinc oxide, zinc hydroxide, and zinc carbonate.

Although the concentration of Group IIA and Group IIB metal cations in the rinse solution is not believed to be particularly critical, an amount must be present which is sufficient to form a modified metal phosphate on the surface and to enhance the resistance of the resulting substrate towards corrosion. This minimum amount will vary depending upon the phosphate source, the resin composition used, the metal cation source selected, the rinse temperature, duration of rinsing, and the like, but may be readily determined through minimal experimentation. Typically, total concentrations of Group IIA and/or Group IIB metal compounds of from about 0.05 to about 5 percent by weight (more preferably, about 0.1 to about 1 percent by weight) will suffice. Expressed a different way, typical Group IIA and/or Group IIB metal cation concentrations in the rinse solution range from about 2 to about 300 mM/L (more preferably, from about 5 to about 100 mM/L). Generally speaking, better corrosion resistance is obtained as the alkaline earth metal cation concentration and/or the phosphate concentration in the rinse solution are increased. However, resistance to brake fluid and solvents and the appearance of the coating may be adversely affected at high alkaline earth metal levels. The aqueous rinse solutions of the present invention preferably contain nitrate in a concentration of about 0.01 to about 2.0 weight % (more preferably, from about 0.03 to about 1.5 weight %).

The phosphate source is included in the rinse solution in an amount to form a modified metal phosphate with the metal substrate. In preferred embodiments of the invention, the substrate metal is iron or steel so that the rinse solution forms what is believed to be a Group IIA or Group IIB metal modified iron phosphate on the iron or steel substrate.

Phosphate anions may be supplied to the rinse solution by any oxy acid of phosphorus, or water-soluble salt thereof, in which the phosphorus is in a +5 valence state. Contrary to the teachings of U.S. Pat. No. 4,636,265, the use of metal hypophosphites in the rinse solution is not required in order to achieve satisfactory enhancement of anticorrosion properties. Thus, in preferred embodiments of the invention, the rinse solution does not contain any metal hypophosphite. In preferred embodiments, the phosphate source is phosphoric acid (e.g., meta and/or ortho phosphoric acid) or a condensed phosphoric acid such as polyphosphoric acid since such species are readily available from commercial sources, easily soluble in the aqueous rinse solution and provides a sufficient pH to form a stable solution. Typically, the oxy acid of phosphorus is added to the rinse solution in an amount to maintain a pH of about 2.5 to about 4.2 and preferably about 3.5 to about 4.0 (where the Group IIA or Group IIB metal is calcium) and preferably about 2.8 to about 3.8 (where the Group IIA or Group IIB metal is zinc). The effective upper pH limit may be determined by the solubilities of the various species present in the rinse solution. For example, calcium phosphate or zinc phosphate may begin to precipitate from solution if the pH is too high. The final pH of the rinse solution can be adjusted as necessary by the addition of an acid or a base to obtain the desired pH. Ammonium hydroxide and ammonia are the preferred bases for raising the pH.

In alternative embodiments the phosphate source can be a metal or alkaline earth metal phosphate that is either soluble in water or that can be solubilized in an acidic solution. In one embodiment the phosphate source can be a phosphate of a metal or alkaline earth metal such as aluminum, zinc, calcium, iron and mixtures thereof. The metal phosphate thus can function as the source of both the Group IIA or Group IIB metal cations and phosphate anions. It will be appreciated that the phosphate source should not form insoluble precipitates in the rinse solution or interfere with the coating of the metal substrate.

In typical embodiments of the invention, the phosphate concentration in the aqueous rinse solution is from about 10 mM/L to about 1000 mM/L, calculated as $PO_4$ (more preferably, from about 40 mM/L to about 250 mM/L). Put a different way, the phosphate concentration in the aqueous rinse solution preferably is from about 0.05 to about 5 weight % (more preferably, from about 0.5 to about 2.5 weight %).

The amount of the acid added to the rinse solution depends in part on the phosphate source and the desired concentration of the phosphate in the rinse solution. Preferably the rinse solution is maintained at an acidic pH, preferably at a pH of about 4.2 or less to avoid precipitation of certain components of the rinse solution. In addition, it has been found that for at least certain embodiments within the scope of the invention the rinse solution is preferably maintained at a pH of about 3.5 or above, since a pH of at least 3.5 promotes the production of better quality cured autodeposition coatings. Under certain conditions, for example, use of a rinse solution with a pH lower than about 3.5 tends to lead to the formation of blisters, pinholes and other defects in autodeposition coatings prepared using particular epoxy resins.

When the phosphate source is a metal phosphate, the acid component used to maintain the pH of the rinse in the desired range of acidity can be any acid that does not interfere with the formation of the Group IIA or Group IIB metal-modified phosphate on the metal substrate surface and does not adversely affect the autodeposition coating deposited on the substrate surface. Examples of suitable acids include hydrochloric, nitric and sulfuric. Various organic acids such as carboxylic acids can also be used that are able to maintain the necessary pH.

The concentration of the acid component used to prepare the rinse is variable depending on the strength of the particular acid and the concentration and acid-base properties of the other components, among other factors. Typically, the acid component is present at a concentration of about 100 meq/L to about 5000 meq/L, and preferably from about 400 meq/L by weight to about 2000 meq/L. In one embodiment, the rinse solution is prepared using about 0.4% to about 2.0% by weight phosphoric acid to provide a pH of 3.5 to 4.0.

In one preferred embodiment, the substrate metal is steel that is rinsed with an aqueous rinse solution prepared using 0.1% to 1 wt % calcium nitrate, 0.4% to 2 wt % phosphoric acid, and 0.1% to 1.0 wt % hydroxylamine having a pH of 3.5 to 4.0. The phosphate in such a rinse solution is believed to be primarily present in the form of calcium dihydrogen phosphate which deposits a coating of a calcium-modified iron phosphate on the surface of the substrate.

In another preferred embodiment, the substrate metal is steel that is rinsed with an aqueous solution prepared using 0.1 to 1.0 wt % zinc oxide, 0.5 to 2.5 wt % phosphoric acid, and 0.1 to 1.0 wt % sodium nitrite having a pH of 2.8 to 3.8.

In preferred embodiments, an accelerator such as hydroxylamine or a hydroxylamine source such as a hydroxylammonium salt or hydroxylamine precursor is included to enhance the performance of the rinse. The accelerator functions as an oxidizing agent in the solution to assist in the dissolution of the metal and the formation of the metal phosphate. The accelerator may be, for example, selected from the group consisting of hydroxylamines, hydroxylammonium salts, nitrites, molybdates, chlorates, oximes, peroxides, persulfates, nitroaromatic compounds (e.g., nitrobenzene sulfonates), or mixtures thereof. Specific examples include hydroxylamine, hydroxylamine sulfate, sodium nitrite, and meta nitrobenzene sulfonic acid.

An accelerator is optional, but generally preferred, in the rinse solution. However, sodium-containing accelerators such as sodium chlorate are less preferred since they can result in some water sensitivity. Preferably the accelerators are those that are most amenable to the formation of the metal phosphate coatings.

When used, the accelerator is typically present in a concentration of from about 0.05 percent by weight to about 5 percent by weight, preferably from about 0.1 percent by weight to about 1 percent by weight. Expressed a different way, the accelerator concentration is typically about 10 to about 3000 mM/L, more preferably from about 20 to about 600 mM/L.

While not necessary to obtain significant improvement in corrosion resistance, other substances besides the Group IIA or Group IIB metal source, phosphate source and optional accelerator could be present in the aqueous rinse. For example, the aqueous rinse solution may contain divalent metal cations such as those of manganese, nickel, cobalt, copper and the like. In one preferred embodiment, the aqueous rinse solution contains both nickel and manganese cations. In this embodiment, Ni is preferably present at a concentration of from about 500 to about 1500 ppm and Mn is preferably present at a concentration from about 100 to about 1000 ppm. Fluoride (in free and/or complexed form) may also be present (typically, at a total fluoride concentration of 100 to 5000 ppm). A major advantage of the present invention is that there is no need to use chromium compounds in the rinse. In preferred embodiments, the rinse solution is chromium-free.

In the method of the invention, the metal substrate autodeposition-coated with the uncured resin as described above is contacted with the rinse solution containing the Group IIA and/or Group IIB metal cation source, phosphate source and optional accelerator according to known methods. For example, the metal substrates can be immersed or dipped in the rinse solution, spray-treated with the solution, roll-coated, or treated with a combined spray/dip procedure. Multiple rinses may be performed if so desired. The duration of treatment typically is from a few seconds to a few minutes, with a period of from about 30 seconds to about 5 minutes being preferred, and a period from about 60 seconds to about 120 seconds being particularly preferred. During the treatment, the solution is generally maintained at a temperature of from about 20° C. to about 100° C. When the uncured resin is comprised of epoxy resin, the solution temperature is more preferably from about 48° C. to about 55° C. The pH of the rinse is maintained in a range effective to provide a cured coating of satisfactory quality (e.g., minimal blister, pinhole or other defect formation) and to avoid precipitation of any components of the rinse solution. As the rinse solution is used, such as, for, example, in a continuous commercial operation, it may be necessary or desirable to periodically replenish the rinse solution to replace the components of the rinse which are being consumed.

Following the rinsing step, the coated metal substrates are cured by a suitable method for the specific coating composition. Generally further rinsing with water alone is not desirable since such rinsing tends to degrade the improvements in corrosion resistance obtained by the rinse of the present invention. Curing may be performed in any known manner, for example by heating (preferably baking) at an elevated temperature (e.g., about 50° C. to about 300° C.). The selection of the particular optimum curing temperature will depend upon the type of resin, cross-linking agent, and coalescent used for the coating, among other factors, but may be readily determined by standard experimental procedures.

It has been found that contacting autodeposition coated substrates with the novel rinse solution before curing produces a more stable coating. The resulting coated substrate has increased resistance to highly corrosive/high temperature environments including superheated steam and boiling water. For example, it has been found that epoxy resin-based autodeposited coatings on a steel substrate, when rinsed with a rinse solution containing calcium nitrate, phosphoric acid and hydroxyl amine, have improved resistance to superheated steam at 166° C. for 30 minutes. Exposure to boiling water for 3–6 hours leads to no loss of adhesion. In contrast, similar tests for coatings rinsed with aqueous calcium nitrate without a phosphate source exhibited severe blistering and delamination. While not desiring to be bound by any particular theory, it is believed that the rinse solution used in the method of the present invention provides a protective deposition coating formed from the alkaline earth metal cations, substrate metal, and phosphate. The rinse solution is believed to form an Group IIA or Group IIB metal-modified phosphate of the substrate metal. In one embodiment, the rinse solution forms what is believed to be a calcium-modified iron phosphate at the surface of the substrate. In another embodiment, the rinse solution forms what is believed to be a zinc-modified iron phosphate at the surface of the substrate.

EXAMPLE 1

An epoxy dispersion containing epoxy resins, cross-linker, coalescing solvent, and surfactant having a particle size range of 100 to 300 nm can be prepared in accordance with the procedures described in U.S. Pat. No. 6,096,806.

A CRS (cold rolled steel) panel (supplied by ACT Laboratories, Inc.) can be cleaned with a conventional alkaline cleaner and rinsed with water prior to being coated using a bath of the above-described epoxy dispersion. The cleaned panel is immersed in the coating bath at ambient temperature for about 90 seconds. The coating bath can contain 15 percent by weight of the epoxy dispersion (about 6 percent bath solids), 0.18 percent by weight ferric fluoride, 0.23 percent by weight hydrofluoric acid, 0.52 percent by weight carbon black (AQUABLACK 255A), and 84.07 percent by weight deionized water.

The uncured film is first rinsed in a tap water bath, then immersed for 60–120 seconds in an aqueous rinse solution containing 0.3 percent by weight of calcium nitrate, 1.2 percent by weight of phosphoric acid, and 0.4 percent by weight of hydroxylamine having a pH of about 3.5 to 4.0. Rinse temperature is maintained at about 48–55° C. The coated, rinsed panels are then cured at 185° C. for 40 minutes.

The cured coating panels when subjected to superheated steam for 30 min at 330° F. and boiling water for 3–6 hours are expected to display no loss of adhesion or blistering of the cured coating as tested by a cross-hatch adhesion test (ASTM D3359).

EXAMPLE 2

ACT CRS panels were coated with an epoxy dispersion as described in Example 1. The panels containing the uncured autodeposited coating were rinsed with tap water and then immersed for 150–200 seconds in an aqueous rinse solution maintained AR about 64–68° C. prepared using 0.41 wt % zinc oxide, 1.09 wt % phosphoric acid, and 0.3–0.55 wt % sodium nitrite. The rinse solution contained 25(±1) points total acid and 4 (±1) points free acid.

After rinsing the coated panels were cured at 185° C. for 40 minutes. The coated, cured panels were subjected to Neutral Salt Spray testing (ASTM B117) for 504 hours. ASTM ratings of 5–6 were obtained.

EXAMPLE 2A

Control

Example 2 was repeated, except that the panels containing the uncured autodeposited coating were immersed in deionized water maintained at 50–55° C. instead of the aqueous rinse solution used in Example 2. The ASTM ratings of the coated, cured panels prepared in this manner were only 1–2, indicating that such panels had significantly poorer corrosion resistance than the panels prepared in accordance with the invention (Example 2).

EXAMPLE 3

ACT CRS panels were coated with an autodeposition composition comprising a mixture (blend) of an epoxy dispersion (prepared in accordance with U.S. Pat. No. 6,096,806) and an acrylic emulsion. The panels containing the uncured autodeposited coating were rinsed with tap water and then immersed for 60–90 seconds in an aqueous rinse solution maintained at about 48–52° C. prepared using 1.2 wt % phosphoric acid, 0.3 wt % calcium nitrate, and 0.4 wt % hydroxylamine (pH 3.5–4.0). The Neutral Salt Spray ratings (ASTM B117) for the cured panels post-rinsed in this manner were 7.

EXAMPLE 3A

Control

Example 3 was repeated, except that the panels containing the uncured autodeposited coating were immersed in deionized water maintained at 50–55° C. instead of the aqueous rinse solution used in Example 3. The Neutral Salt Spray ratings of the resulting cured, coated panels were only 1–2, confirming that the corrosion resistance is greatly enhanced using a solution in accordance with the invention.

EXAMPLE 4

ACT CRS panels were coated with an autodeposition composition based on NEOCRYL XK 64 acrylic styrene copolymer emulsion ( a product of the NeoResins division of Avecia). The panels containing the uncured autodeposited coating were rinsed with tap water and them immersed for 150–200 seconds in an aqueous rinse solution maintained at about 64–68° C. prepared using 0.41 wt % zinc oxide, 1.09 wt % phosphoric acid, and 0.3–0.55 wt % sodium nitrite. The rinse solution contained 25(±1) points total acid and 4(±1) points free acid.

After rinsing, the coated panels were cured at 125° C. for 30 minutes. The coated, cured panels were subjected to Neutral Salt Spray testing (ASTM B117) for 504 hours. ATSM ratings of 5–6 were obtained.

EXAMPLE 4A

Control

Example 4 was repeated, except that the panels containing the uncured autodeposited coating were immersed in deionized water maintained at 50–55° C. instead of the aqueous rinse solution used in Example 4. The ASTM ratings of the coated, cured panels prepared in this manner were only 1–2, indicating that such panels had significantly poorer corrosion resistance than the panels prepared in accordance with the invention (Example 4).

EXAMPLE 5

ACT CRS panels were coated with an autodeposition composition based on NEOCRYL XK64 acrylic styrene copolymer emulsion. The panels containing the uncured autodeposited coating were rinsed with tap water and then immersed for 150–300 seconds in an aqueous rinse solution maintained at about 35–40° C. containing 1500–2000 ppm of Zn, 800–1200 ppm of Ni, 300–500 ppm of Mn, 1.4–1.7 wt % phosphate, 0.9–1.1 wt % nitrate, and total fluoride of 500–1500 ppm. The rinse solution contained 22 (±2) points total acid and 0.3–0.7 points free acid.

After rinsing the coated panels were cured at 125° C. for 40 minutes. The coated, cured panels were subjected to Neutral Salt Spray testing (ASTM B117) for 504 hours. ASTM ratings of 5–6 were obtained.

EXAMPLE 5A

Control

Example 5 was repeated, except that the panels containing the uncured autodeposited coating were immersed in deionized water maintained at 50–55° C. instead of the aqueous rinse solution used in Example 5. The ASTM ratings of the coated, cured panels prepared in this manner were only 1–2, indicating that such panels had significantly poorer corrosion resistance than the panels prepared in accordance with the invention (Example 5).

While various embodiments have been chosen to demonstrate the invention, it will be appreciated by those skilled in the art that various modifications can be made without departing the scope of the invention as defined in the appended claims.

What is claimed is:

1. A method of improving the corrosion resistance of a metallic surface having a cured autodeposited coating adhered thereto, said method comprising contacting an uncured autodeposited coating present on said metallic surface with an aqueous rinse comprising amounts of at least one source of metal cation selected horn the group consisting of Group IIA and Group IIB metal cations and at least one phosphate source effective to improve the corrosion resistance of said metallic surface, wherein said rinse is free of chromium and hypophosphite.

2. The method of claim 1, wherein said aqueous rinse is acidic.

3. The method of claim 1, wherein said aqueous rinse has a concentration of said metal cations of from about 2 mM/L to about 300 mM/L.

4. The method of claim 1, wherein said aqueous rinse is comprised of calcium cations.

5. The method of claim 1 wherein said aqueous rinse is comprised of zinc cations.

6. The method of claim 1, wherein said phosphate source is selected from the group consisting of phosphoric acid, condensed phosphoric acids, and water-soluble salts thereof.

7. The method of claim 1, wherein said aqueous rinse is additionally comprised of at least one accelerator.

8. The method of claim 7, wherein said accelerator is selected from the group consisting of hydroxylamine, hydroxyl ammonium salts, and nitrites.

9. The method of claim 1, wherein the uncured autodeposited coating comprises at least one resin selected from the group consisting of epoxy resins, acrylic resins, and combinations thereof.

10. The method of claim 1 wherein said method comprises contacting said uncured autodeposited coating with said aqueous rinse at a temperature of from about 20° C. to about 100° C.

11. The method of claim 1 wherein the aqueous rinse is comprised of nitrate anions and cations selected from the group consisting of zinc cations, calcium cations, and mixtures thereof.

12. The method of claim 1, wherein said aqueous rinse is prepared using calcium nitrate and phosphoric acid and has a pH of about 3.5 to 4.0.

13. The method of claim 1, wherein said aqueous rinse has a phosphate concentration of from about 10 mM/L to about 1000 mM/L.

14. The method of claim 1, further comprising curing said autodeposited coating after said contacting step.

15. The method of claim 1, wherein said aqueous rinse is comprised of nitrate anions.

16. A method of improving the corrosion resistance of a metallic surface having a cured autodeposited coating adhered thereto, said method comprising contacting an uncured autodeposited coating present on said metallic surface with an aqueous rinse comprising amounts of at least one source of metal cations selected from the group consisting of Group IIA and Group IIB metal canons and at least one phosphate source effective to improve the corrosion resistance of said metallic surface, wherein said aqueous rinse is comprised of nitrate anions.

17. The method of claim 16, wherein the aqueous rinse has a Group IIA or Group IIB metal cation concentration of from about 5 mM/L to about 100 mM/L and a phosphate concentration of from about 40 mM/L to about 250 mM/L.

18. The method of claim 17 wherein the aqueous rinse is acidic.

19. The method of claim 17 wherein the aqueous rinse contains about 10 mM/L to about 3000 mM/L of an accelerator.

20. The method of claim 16, wherein the aqueous rinse is acidic.

21. The method of claim 16, wherein said aqueous rinse comprises zinc cations and/or calcium cations.

22. The method of claim 16, wherein the aqueous rinse contains about 10 mM/L. to About 3000 mM/L. of an accelerator.

23. The method of claim 16, wherein the uncured autodeposited coating comprises at least one resin selected from the group consisting of epoxy resins, acrylic resins, and combinations thereof.

24. The method of claim 16, wherein the aqueous rinse is free of chromium.

25. The method of claim 16, wherein the aqueous rinse is free of hypophosphite.

26. The method of claim 16, wherein the aqueous rinse is prepared using calcium nitrate and phosphoric acid and has a pH of about 3.5 to 4.0.

27. A method of improving the corrosion resistance of a steel surface, said method comprising a) contacting said steel surface with an autodeposition bath comprising a resin in uncured emulsion or dispersion form and an autodeposition activator until a layer of the resin of desired thickness is autodeposited on said steel surface;

b) rinsing said steel surface having the layer of resin autodeposited thereon with a chromium-free and hypophosphite-free aqueous solution comprising an anticorrosive effective amount of at least one Group IIA or Group IIB metal cation source and at least one phosphate source; and c) curing the layer of resin autodeposited on said steel surface.

28. The method of claim 27 wherein calcium nitrate is used as at least a portion of the Group IIA or Group IIB metal cation source.

29. The method of claim 27 wherein phosphoric acid, a condensed phosphoric acid, or a mixture thereof is used as at least a portion of the phosphate source.

30. The method of claim 27 wherein said aqueous rinse additionally comprises an accelerator selected from the group consisting of hydroxylamine, hydroxylammonium salts, nitrites, molybdates, peroxides, persulfates, chlorates, nitroaromatic compounds and mixtures thereof.

31. The method of claim 27 wherein said accelerator is hydroxylamine or a hydroxylammonium salt.

32. The method of claim 27 wherein said resin comprises at least one resin selected from the group consisting of epoxy resins, acrylic resins and combinations thereof.

33. The method of claim 27 wherein said rinsing step (b) is performed at a temperature of from about 20° C. to about 100° C.

34. The method of claim 27 wherein said aqueous solution is comprised of from about 0.01 to about 2 weight % nitrate.

35. The method of claim 27 wherein said aqueous solution has a pH at least about 3.5.

36. The method of claim 27 wherein the aqueous solution has a Group IIA or Group IIB metal cation concentration of from about 2 to about 300 mM/L.

37. The method of claim 27 wherein said aqueous solution is prepared using calcium nitrate and phosphoric acid and has a pH of not less than about 3.5.

38. A method of improving the corrosion resistance of a metallic surface having a cured aurodeposited coating adhered thereto, said method comprising:

1) contacting an uncured aurodeposited coating present on said metallic surface with an aqueous rinse comprising:
   a) water;
   b) about 2 to 300 mM/L of canons of one or more metals selected from the group consisting of Group IIA metal canons and Group IIB metal cation;
   c) about 10 to about 1000 mM/L phosphate; and
   d) about 10 to about 3000 mM/L of at least one accelerator;
   wherein said aqueous rinse is acidic, free of chromium and hypophosphite, and maintained at a temperature of from about 20° C. to about 100° C. during said contacting; and
2) curing said uncured autodeposited coating without further rinsing with water alone.

39. The method of claim 38 wherein the aqueous rinse is additionally comprised of from about 0.01 to about 2 wt % nitrate.

40. The method of claim 38 wherein said metal cations are selected from the group consisting of calcium cations, zinc cations, and mixtures thereof.

41. The method of claim 38 wherein said aqueous rinse is additionally comprised of cation selected from the group consisting of nickel, manganese, and mixtures thereof.

42. A method of improving the corrosion resistance of a metallic surface having a cured autodeposited coating adhered thereto, said method comprising contacting an uncured autodeposited coating present on said metallic surface with an aqueous rinse comprising amounts of at least one source of metal cations selected from the group consisting of Group IIA and Group IIB metal cations and at least one phosphate source effective to improve the corrosion resistance of said metallic surface, wherein the aqueous rinse has a pH of 4.2 or less and comprises at least one accelerator.

* * * * *